US007093779B2

(12) United States Patent
Sebastian et al.

(10) Patent No.: US 7,093,779 B2
(45) Date of Patent: Aug. 22, 2006

(54) FUEL INJECTION VALVE

(75) Inventors: Thomas Sebastian, Charleston, SC (US); Juergen Graner, Sersheim (DE); Wolfgang-Manfred Ruehle, Ditzingen (DE); Joachim Stilling, Pfaffenhofen (DE); Matthias Boee, Ludwigsburg (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 390 days.

(21) Appl. No.: 10/416,046

(22) PCT Filed: Jun. 21, 2002

(86) PCT No.: PCT/DE02/02298

§ 371 (c)(1),
(2), (4) Date: Oct. 9, 2003

(87) PCT Pub. No.: WO03/027482

PCT Pub. Date: Apr. 3, 2003

(65) Prior Publication Data

US 2006/0011751 A1 Jan. 19, 2006

(30) Foreign Application Priority Data

Sep. 5, 2001 (DE) ..... 101 43 500

(51) Int. Cl.
*B05B 1/30* (2006.01)

(52) U.S. Cl. ..... 239/585.1; 239/585.3; 239/585.4; 239/585.5; 239/900; 251/129.16

(58) Field of Classification Search ..... 239/585.1, 239/585.3, 585.4, 585.5, 900, 483; 251/129.16, 251/129.15, 129.21
See application file for complete search history.

(56) References Cited

U.S. PATENT DOCUMENTS 3,731,881 A * 5/1973 Dixon et al. ..... 239/585.3
4,331,317 A * 5/1982 Kamai et al. ..... 251/129.21
5,884,850 A * 3/1999 Norgauer ..... 239/585.5

FOREIGN PATENT DOCUMENTS

| | | |
|---|---|---|
| DE | 36 27 793 | 2/1988 |
| DE | 36 43 523 | 6/1988 |
| DE | 44 26 006 | 1/1996 |
| DE | 196 26 576 | 1/1998 |
| EP | 0 200 865 | 11/1986 |
| WO | WO 01 44653 | 6/2001 |
| WO | WO01/44653 A * | 6/2001 |

* cited by examiner

*Primary Examiner*—Dinh Q. Nguyen
(74) *Attorney, Agent, or Firm*—Kenyon & Kenyon LLP

(57) ABSTRACT

A fuel injector, in particular a fuel injector for fuel-injection systems of internal combustion engines, has a valve needle which cooperates with a valve-seat surface to form a sealing seat, and an armature which is connected to the valve needle, the armature being acted upon in the closing direction by a restoring spring and cooperating with a magnetic coil. The armature has a guide flange which is guided at an opposite surface. The guide flange does contact the opposite surface in all places, so that recesses are formed between the guide flange and the opposite surface.

7 Claims, 2 Drawing Sheets

FUEL INJECTION VALVE

FIELD OF THE INVENTION

The present invention relates to a fuel injector.

BACKGROUND INFORMATION

From German Published Patent Application No. 196 26 576, a fuel injector is already known where an electromagnetic coil cooperates with an armature, which is in force-locking connection to a valve needle at whose spray-discharge end a valve-closure member is positioned. The armature is embodied as a plunger armature which is guided in a magnetic restrictor of the magnetic circuit. The armature is provided with a circumferential flange, which forms the upper bearing position. The guide flange is supported in the magnetic restrictor between the two poles of the magnetic circuit. As a result of this design, the guide flange of the armature and the section of the housing on which the guide flange extends, are at comparable magnetic potentials, so that no crossover of the magnetic flux occurs at the guide flange. By the guide flange being supported in the magnetic restrictor, the guide flange thus remains free of magnetic radial forces.

A particular disadvantage of the aforementioned printed publication is the large overall length of the armature, which makes a weight optimization of the armature more difficult. In addition, the circumferential guide flange on the armature obstructs the draining of fuel from the working gap, so that larger hydraulic losses result.

Furthermore, it is known to guide the section of the valve needle facing the armature inside a component of the housing. The armature is not guided in the housing or in the pole component.

Disadvantageous in the guidance of the valve needle in a guide component positioned downstream from the armature, in particular, are the radial forces which, due to an eccentric positioning of the armature, act on the component made up of armature and valve needle. Especially because of the disadvantageous lever ratios between the valve-needle guide sections and the point where the magnetic radial forces become active, this sometimes produces considerable frictional forces in the guide sections. Even slight offsets or manufacturing tolerances of the valve needle, the guide sections or the armature cause eccentric offsets of the armature, resulting in high frictional forces and, thus, in wear of the components and malfunctions of the fuel injector.

SUMMARY OF THE INVENTION

In contrast, the fuel injector according to the present invention has the advantage over the related art that a circumferential guide flange, which is wave-shaped and surrounds the armature but does not abut in all places, guides the armature in the outer pole of the fuel injector, thereby counteracting tilting or lateral offsets.

The wave-shaped contour of the circumferential guide flange allows the fuel to flow to the valve seat through the recesses formed between the guide flange and the opposite surface in an unobstructed manner and, thus, a rapid draining of the working gap. This prevents hydraulic losses.

It is also advantageous that the guide flange does not take up any particular length of the armature shaft, but may be affixed to a conventional armature in a simple manner, thereby allowing the armature mass to be optimized.

Especially advantageous is the angle-fault tolerance of the armature guidance which minimizes the eccentricity of the radial areas of the armature surrounding the guide flange, thereby keeping the frictional forces low.

The armature with the guide flange is advantageously able to be produced in a simple manner by turning; the wave contour may include between two and ten waves, for example.

DETAILED DESCRIPTION

Figure 1:
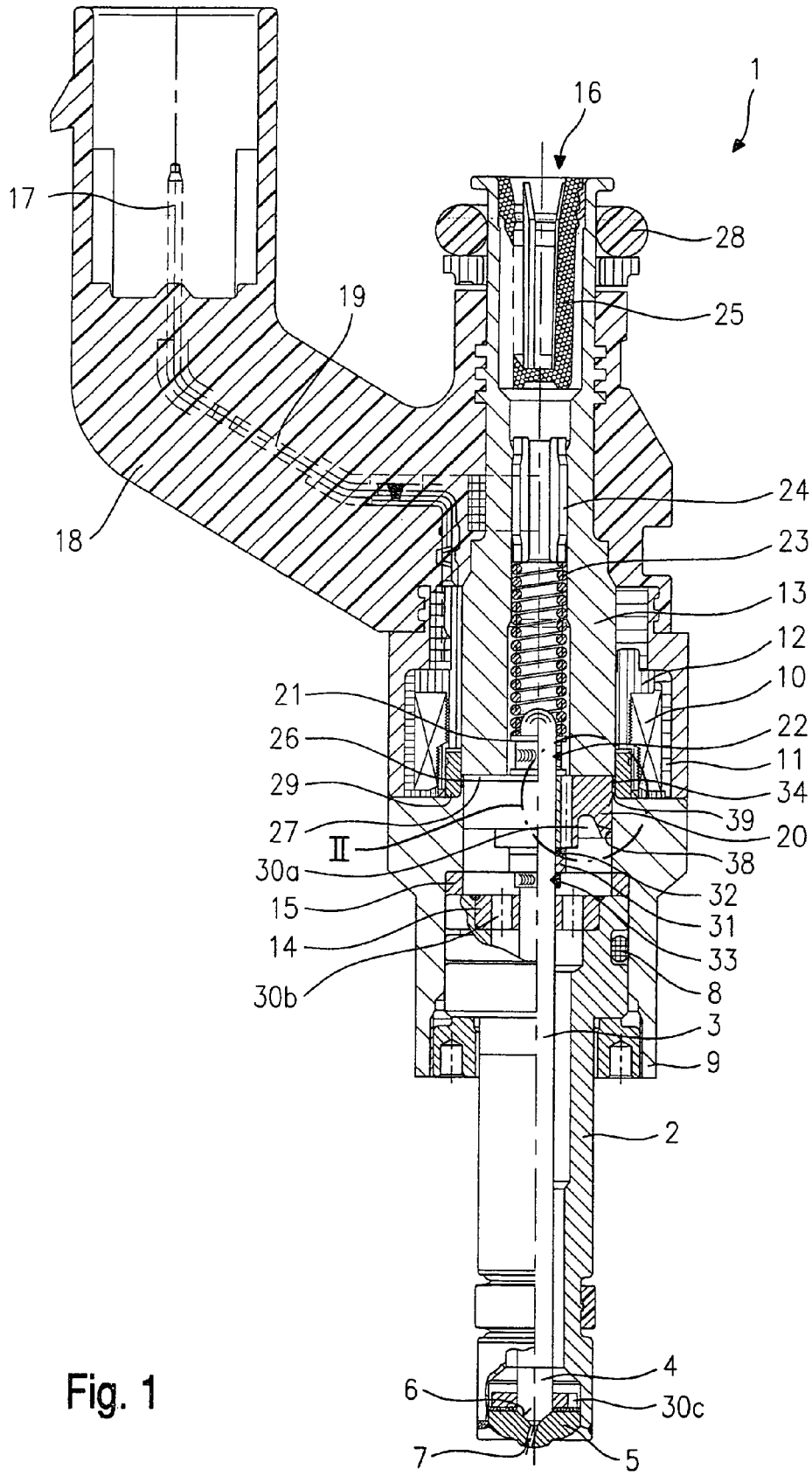
FIG. 1 shows a schematic section through an exemplary embodiment of a fuel injector configured according to the present invention, in an overall view.

A fuel injector 1 represented in FIG. 1 is configured in the form of a fuel injector for fuel-injection systems of mixture-compressing internal combustion engines with externally supplied ignition. Fuel injector 1 is particularly suited for the direct injection of fuel into a combustion chamber (not shown) of an internal combustion engine.

Fuel injector 1 is made up of a nozzle body 2 in which a valve needle 3 is positioned. Valve needle 3 is in operative connection with a valve-closure member 4, which cooperates with a valve-seat surface 6 located on a valve-seat member 5 to form a sealing seat. In the exemplary embodiment, fuel injector 1 is an inwardly opening fuel injector 1, which has one spray-discharge orifice 7. A seal 8 seals nozzle body 2 from outer pole 9 of a magnetic circuit having a magnetic coil 10. Magnetic coil 10 is encapsulated in a coil housing 11 and wound on a bobbin 12 which abuts against an inner pole 13 of the magnetic circuit. Inner pole 13 and outer pole 9 are separated from one another by a constriction 26 and are interconnected by a non-ferromagnetic connecting part 29. Magnetic coil 10 is energized via a line 19 by an electric current which may be supplied via an electrical plug contact 17. A plastic extrusion coat 18, which may be extruded onto inner pole 13, encloses plug contact 17.

Valve needle 3 is guided in a valve-needle guide 14, which is designed in the shape of a disk and forms an upper support position of valve needle 3. A paired adjustment disk 15 is used to adjust the (valve) lift. On the other side of adjustment disk 15 is an armature 20 which, via a first flange 21, is connected by force-locking to valve needle 3, which is connected to first flange 21 by a welding seam 22. Braced on first flange 21 is a restoring spring 23 which in the present design of fuel injector 1 is provided with an initial stress by a sleeve 24. Fuel channels 30*a* through 30*c* run in valve-needle guide 14, in armature 20 and valve-seat member 5. The fuel is supplied via a central fuel feed 16 and filtered by a filter element 25. A seal 28 seals fuel injector 1 from a fuel distributor line (not shown further).

On the spray-discharge side of armature 20 is an annular damping element 32 made of an elastomeric material. It rests on a second flange 31, which is joined to valve needle 3 by force-locking via a welded seam 33.

In the rest position of fuel injector 1, return spring 23 acts upon valve needle 3 counter to its lift direction in such a way that valve-closure member 4 is retained in sealing contact against valve seat 6. In response to excitation of magnetic coil 10, it generates a magnetic field which moves armature 20 in the lift direction, counter to the spring force of restoring spring 23, the lift being predefined by a working gap 27 which occurs in the rest position between inner pole 12 and armature 20. First flange 21, which is welded to valve needle 3, is taken along by armature 20 in the lift direction as well. Valve-closure member 4, being in connection with valve needle 3, lifts off from valve-seat surface 6, and the fuel is spray-discharged through spray-discharge orifice 7.

In response to interruption of the coil current, following sufficient decay of the magnetic field, armature 20 falls away from inner pole 13 due to the pressure of restoring spring 23, whereupon first flange 21, being connected to valve needle 3, moves in a direction counter to the lift. Valve needle 3 is thereby moved in the same direction, causing valve-closure member 4 to set down on valve seat surface 6 and fuel injector 1 to be closed.

Valve needle 3, as already described above, is thus only supported downstream from armature 20 which causes disadvantageous lever ratios and, thus, offsets of armature 20. This is made worse, in particular, by manufacturing tolerances of valve-needle guide 14. Therefore, the present invention provides for armature 20 to have a wave-shaped guide flange 34 which is formed on armature 20 in such a way that it is able to guide armature 20 in an offset-free manner. The measures according to the present invention are represented in detail in FIGS. 2 and 3 and explained more clearly in the following description.

Figure 2:
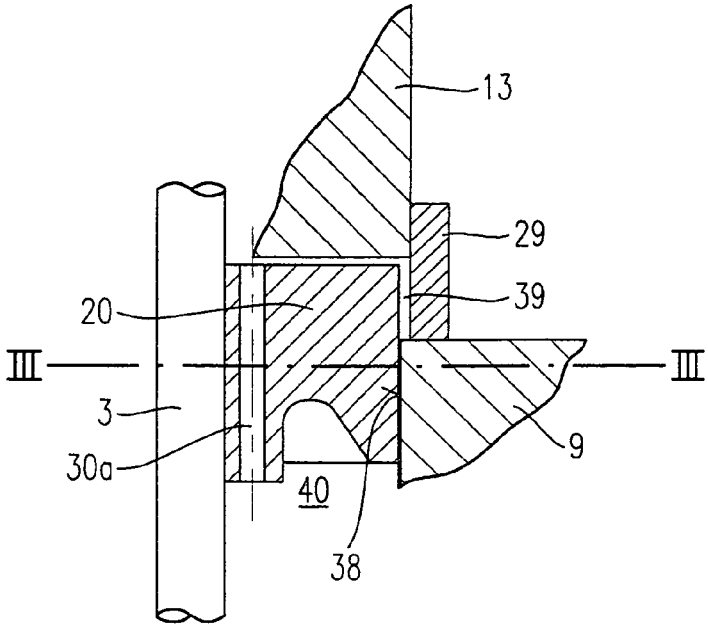
FIG. 2 shows a schematic section through the exemplary embodiment of a fuel injector configured according to the present invention as shown in FIG. 1, in region II of FIG. 1.

In an part-sectional view, FIG. 2 shows the detail of fuel injector 1 configured according to the present invention, which is designated by II in FIG. 1.

As already mentioned in the description in connection with FIG. 1, fuel injector 1 of the present invention has an armature 20 which is provided with a guide flange 34. Armature 20 is integrally formed with guide flange 34 and is produced, for instance, by turning. Guide flange 34 is supported at an inner wall 38 of recess 40 of outer pole 9, inner wall 38 forming an opposite surface 41. Guide flange 34 has flattened regions 42 and, therefore, does not abut against opposite surface 41 in all places, so that a plurality of recesses 40 is present between guide flange 34 and the opposite surface.

In a controlled magnetic circuit, parasitic magnetic forces are produced in radial gap 39. In an armature 20 that is in an optimally centered position or in the case of components which have been produced with very low manufacturing tolerances, the generated radial forces at the circumference cancel each other out. In contrast, in a non-centered placement of armature 20 or in the case of large manufacturing tolerances of the components, the parasitic forces result in friction in valve-needle guide 14 and thus in losses in the switching dynamics of fuel injector 1 and in wear, especially of valve-needle guide 14.

The ferritic material volumes of guide flange 34 and outer pole 9, disposed opposite to guide flange 34, are heavily saturated over a long period of time during the control cycle of fuel injector 1, so that they almost always have high magnetic resistances. They are connected in series to the specific resistances of working gap 27 and radial gap 39 and result in a compensation of the magnetic radial forces at the circumference of guide flange 34 of armature 20.

Due to armature 20 being guided in a manner that is tolerant of angle faults, and low eccentricity in outer pole 9, very low outer magnetic radial forces occur at the circumference of armature 20. The remaining slight outer radial force is absorbed by guide flange 34 in the places where it occurs. As a result, valve-needle guide 14 remains free of radial forces. Even a tilting of armature 20 relative to a longitudinal axis of fuel injector 1 only leads to negligible radial offsets of armature 20, so that it is possible to ensure a perfect functioning of fuel injector 1.

Figure 3:
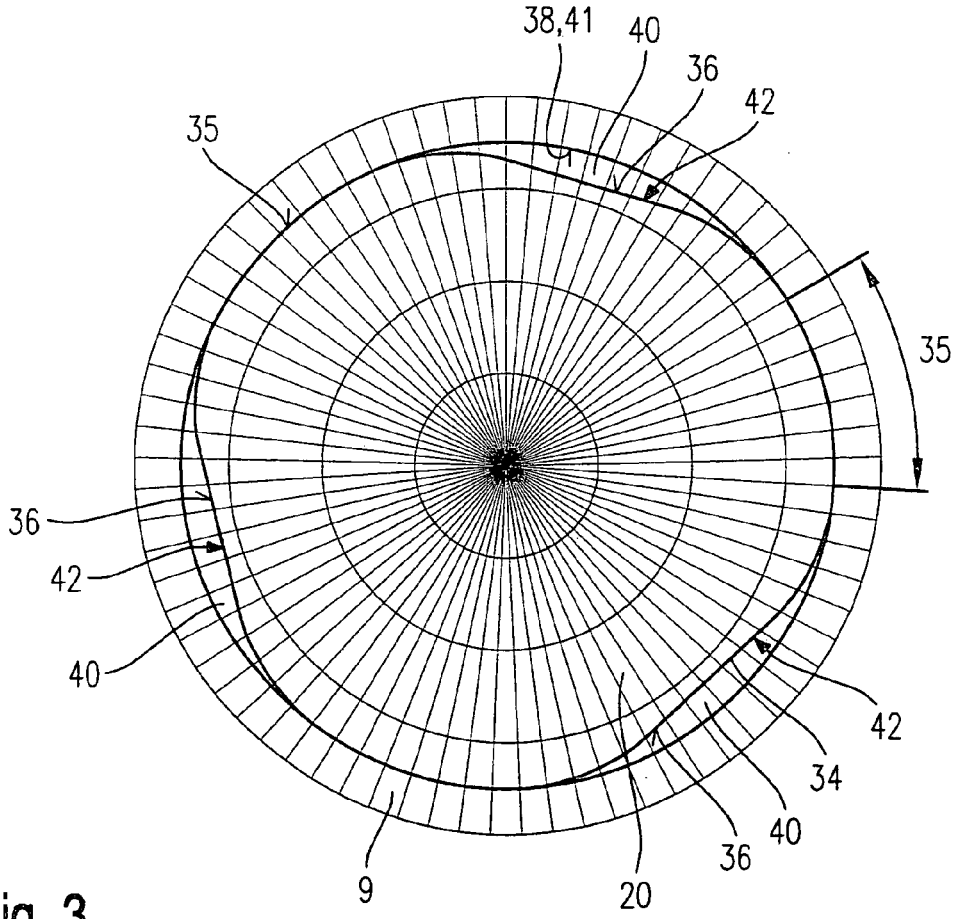
FIG. 3 shows a schematic cross section along line III—III through the armature of the fuel injector configured according to the measures of the present invention.

FIG. 3 shows a schematic cross section, along line III—III in FIG. 2, through armature 20 of the fuel injector configured according to the measures of the present invention.

As already mentioned, in the present exemplary embodiment, guide flange 34 is formed with flattened regions 42 having a wave-shaped design, so that contact surfaces 35 alternate with recessed regions 36. Due to recessed regions 36, the centrally supplied fuel is able to flow around armature 20 and continue into a recess 40 of fuel injector 1 to reach the sealing seat. Corresponding to the number of contact surfaces 35, there are between two and, for example, ten recessed regions 36 of wave-shaped guide flange 34 across the circumference. In the present exemplary embodiment, three contact surfaces 35 and, thus, three recessed regions 36 are represented. In the circumferential direction, recessed regions 36 of wave-shaped guide flange 34 may have the same, a larger or a smaller extension than the intermediate contact surfaces 35.

Wave-shaped guide flange 24, by way of contact surfaces 35, abuts against inner wall 38 of outer pole 9 of the magnetic circuit and is thus guided by outer pole 9.

Recessed regions 36 of wave-shaped guide flange 34 provide for a rapid draining of the fuel from working gap 27. In this way, the hydraulic losses in working gap 27 may be kept low during attraction or falling away of armature 20.

The present invention is not limited to the exemplary embodiment shown and is also applicable, for instance, to outwardly opening fuel injectors 1.

What is claimed is:

1. A fuel injector, comprising:

a valve seat surface;

a restoring spring;

a magnetic coil;

a valve needle that cooperates with the valve-seat surface to form a sealing seat; and an armature that is connected to the valve needle and is acted upon in a closing direction by the restoring spring, the armature cooperating with the magnetic coil and having a guide flange that is formed around a circumference of the armature and guided at an opposite surface, wherein:

the guide flange is wave shaped and includes flattened regions that deviate from a circular outer contour of the armature, so that at least one recess is present between the guide flange and the opposite surface.

2. The fuel injector as recited in claim 1, wherein:

the fuel injector is for a fuel injector system of an internal combustion engine.

3. The fuel injector as recited in claim 1, wherein:

the guide flange includes contact surfaces that are guided at an inner wall of an outer pole.

4. The fuel injector as recited in claim 3, wherein:

the guide flange includes recessed regions that alternate with the contact surfaces in a circumferential direction.

5. The fuel injector as recited in claim 1, wherein:

the guide flange is integrally formed with the armature.

6. The fuel injector as recited in claim 1, wherein:

the guide flange is in a region of a heaviest radial magnetic flux.

7. A fuel injector, comprising: a valve seat surface; a restoring spring; a magnetic coil; a valve needle that cooperates with the valve-seat surface to form a sealing seat; and an armature that is connected to the valve needle and is acted upon in a closing direction by the restoring spring, the armature cooperating with the magnetic coil and having a guide flange that is formed around a circumference of the armature and guided at an opposite surface, wherein:

the guide flange includes flattened regions that deviate from a circular outer contour of the armature, so that at least one recess is present between the guide flange and the opposite surface, the armature includes a wave-shaped outer contour in a region of the guide flange.

* * * * *